United States Patent [19]

Szajewski

[11] Patent Number: 4,855,220

[45] Date of Patent: Aug. 8, 1989

[54] PHOTOGRAPHIC ELEMENT HAVING LAYER FOR INCREASING IMAGE SHARPNESS COMPRISING A NON-DIFFUSION DIR COMPOUND

[75] Inventor: Richard P. Szajewski, Rochester, N.Y.

[73] Assignee: Eastman Kodak Company, Rochester, N.Y.

[21] Appl. No.: 144,889

[22] Filed: Jan. 14, 1988

[51] Int. Cl.[4] ..... G03C 1/46; G03C 7/32; G03C 1/84

[52] U.S. Cl. ..... 430/505; 430/223; 430/510; 430/511; 430/544; 430/553; 430/555; 430/557; 430/558; 430/957

[58] Field of Search ..... 430/505, 223, 543, 544, 430/553, 555, 557, 558, 955, 956, 957, 510, 511

[56] References Cited

U.S. PATENT DOCUMENTS

| | | | |
|---|---|---|---|
| 3,620,745 | 11/1971 | Seymour | 430/505 |
| 3,632,345 | 1/1972 | Marx et al. | 430/543 |
| 3,869,291 | 3/1975 | Mader et al. | 430/544 |
| 4,312,941 | 1/1982 | Scharf et al. | 430/510 |
| 4,391,884 | 7/1983 | Meyer et al. | 430/17 |
| 4,746,600 | 5/1988 | Watanabe et al. | 430/505 |

FOREIGN PATENT DOCUMENTS

| | | | |
|---|---|---|---|
| 0208502 | 1/1986 | European Pat. Off. | 03 C/7/30 |

OTHER PUBLICATIONS

Research Disclosure, Item No. 17643, Sections VII-F and VIII-C, Dec. 1978.

*Primary Examiner*—Paul R. Michl
*Assistant Examiner*—Patrick A. Doody
*Attorney, Agent, or Firm*—Paul L. Marshall

[57] ABSTRACT

A photographic element is disclosed that comprises a support having thereon spectrally-sensitized light-sensitive silver halide, a color dye-forming coupler, a DIR compound capable of inhibiting development of the silver halide, and, between the silver halide layer and the source of the image exposure, a layer comprising a non-diffusible filter dye that absorbs light in the region of the spectrum to which the silver halide is sensitized.

6 Claims, No Drawings

PHOTOGRAPHIC ELEMENT HAVING LAYER FOR INCREASING IMAGE SHARPNESS COMPRISING A NON-DIFFUSION DIR COMPOUND

FIELD OF THE INVENTION

This invention relates in general to photography and specifically to photographic elements having layers for increasing image sharpness.

BACKGROUND OF THE INVENTION

When light enters a photographic element and strikes a light-sensitive emulsion layer, a portion of that light is reflected back toward the surface of the element. This effect is known as "back-scatter". When the back-scattered light reaches the surface of the element (i.e., the element/air interface), this light can then be reflected back into the element. This effect is known as "halation". The back-reflected light can then expose portions of light-sensitive layers at large lateral distances from the initial point at which the light entered the element, thus leading to losses in sharpness of the image formed in the element. Similar losses in sharpness can also occur when back-scattered light is reflected back into a photographic element by overlying scattering materials such as silver halides.

It is known, as disclosed in U.S. Pat. No. 4,312,941, to incorporate in an upper layer of a photographic element, a filter dye in order to absorb back-scattered light to reduce the amount of light that is back-reflected into the element.

It has also been known to use development inhibitor releasing (DIR) compounds in photographic elements for a variety of purposes. A primary reason for using such compounds is to improve the sharpness of the image formed in the photographic element. By inhibiting development (and consequently, image formation) at the center of an area of exposure, the DIR compounds enhance the edge of the image area, thus improving sharpness. This improvement, however, is unrelated to the amount of back-reflection of light in the element.

SUMMARY OF THE INVENTION

It has now been found that by incorporating in a photographic element both a DIR compound and a non-diffusible filter dye, surprisingly large improvements in image sharpness can be obtained. This improvement in sharpness is greater than one would believe obtainable, based on the improvements in sharpness obtained through the use of a DIR and a non-diffusible filter dye individually, or through the use of a DIR and a diffusible filter dye.

The DIR compound is located in a layer of the photographic element comprising spectrally-sensitized light-sensitive silver halide and a color dye-forming coupler, or in a different layer where it can inhibit the development of the above-mentioned silver halide. The non-diffusible filter dye is a dye that absorbs light in the region of the spectrum to which the above-mentioned silver halide is sensitized, and is located in a layer between the silver halide layer and the source of the image exposure.

DESCRIPTION OF THE PREFERRED EMBODIMENTS

The DIR compound used in the invention can be any DIR that is useful to improve image sharpness in photographic elements. Such DIR's are well-known in the art and are generally of the formula:

COUP-INHIB where COUP represents a coupler group that cleaves from INHIB upon reaction with oxidized developer and INHIB represents an development inhibitor group. Hydrazide based releasers, as in Harder U.S. Pat. No. 4,684,604, hydroquinone releasers as in U.S. Pat. No. 3,379,529 and U.S. Pat. No. 3,639,417 and heatable releasers as in U.S. Pat. No. 4,678,739, are other examples of inhibitor releaser suitable for use in this invention. The inhibitor group may include a so-called 'switch' or timing group functionality, causing it to be activated or deactivated by certain chemical reaction sequences, such as intramolecular elimination reactions or intramolecular or intermolecular nucleophilic displacement reactions after a certain time period has passed from the coupling-off reaction.

DIR's useful in the invention include the DIR couplers described in Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,617,291, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, UK Pat. No. 1,201,110, Oishi et al U.S. Pat. No. 3,642,485, Verbrugge U.K. Pat. No. 1,236,767, Fujiwhara et al U.S. Pat. No. 3,770,436, and Matsuo et al U.S. Pat. No. 3,808,945, the disclosures of which are incorporated herein by reference. Useful DIR's also include DIAR compounds (DIR's where the inhibitor group is linked to the coupler group through a timing group) as described in Lau U.S. Pat. No. 4,248,962, quinone-methide switch compounds of U.S. Pat. No. 4,409,323, formaldehyde switches as in Harder U.S. Pat. No. 4,684,604, redox switches as in U.S. Pat. No. 4,678,743 and U.S. Pat. No. 4,618,571, and multiple switches as in U.S. Pat. No. 4,698,297, DIR's with particularly mobile inhibitor groups of EP No. 101,621, DIR's that release self-deactivating inhibitors of U.S. Pat. No. 4,477,563, oxime switch releasers of German OLS No. 3,319,428, mixtures of DIR compounds as described in U.S. Pat. No. 4,015,988, EP No. 88,563, Japanese Kokai Nos. 59/59962 and 59/149354, East German No. 238281, and German OLS No. 3,506,805, as well as mixtures of DIR compounds and development accelerators as described in U.S. Pat. Nos. 4,153,460, 4,484,731, 4,618,571, and Japanese Kokai Nos. 60/153039 and 61/121842, the disclosures of which are incorporated herein by reference.

One advantage of the present invention is that it provides, using substantially non-diffusible DIR's, images having sharpnesses that have previously been obtainable only with diffusible DIR's. Diffusible DIR's have interimage effects on the color balance of the photographic element, which can be a significant disadvantage to certain color films, such as motion picture intermediate films. Also, the interimage effect of diffusible DIR's can be a limiting factor on the amount and type of DIR that can be incorporated, limiting the degree of sharpness improvement that can be obtained. Thus, in a preferred embodiment of the invention, the DIR is substantially non-diffusible.

By substantially non-diffusible DIR, it is meant DIR's having a degree of diffusion of less than about 0.4 on reacting with an oxidation product of a development agent during development, as defined and described in EP No. 114,675, the disclosure of which is incorporated herein by reference. By diffusible DIR, it is meant DIR's having a degree of diffusion of greater than about 0.4 on reacting with an oxidation product of a development agent during development.

Substantially non-diffusible DIR's are described, for example, in U.S. Pat. Nos. 3,148,062, 3,227,554, 3,733,201, 3,617,291, 3,703,375, 3,617,291, 3,265,506, 3,620,745, 3,632,345, and 3,869,291, the disclosures of which are incorporated herein by reference.

Methods for making DIR's useful in the invention are well-known in the art, and are described in the above-mentioned DIR patents.

The amount of DIR present in the element of the invention can be any amount known to be useful, as described in any of the above-mentioned references, and is generally between $10^{-1}$ and $10^{-4}$ moles of DIR per mole of silver halide.

The light-sensitive silver halide useful in the practice of the invention can be any of the known types, including conventional silver halide emulsions as described in *Research Disclosure,* Item 17643, December, 1978 [hereinafter referred to as *Research Disclosure I*] and tabular grain silver halide emulsions as described in *Research Disclosure,* Item 22534, January, 1983, the disclosures of which are incorporated herein by reference in their entirety. The amount of silver halide can be any amount known to be useful in photographic elements, and will generally be from 50 to 2000 mg/ft$^2$.

The silver halide is spectrally-sensitized with any of a number of known sensitizing dyes, as described in *Research Disclosure I.* These dyes include cyanines, merocyanines, complex cyanines and merocyanines (e.g., tri-, tetra-, and poly-nuclear cyanines and merocyanines), oxonols, hemioxonols, styryls, merostyryls, and streptocyanines. The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium, dihydronahpthothiazolium, pyrylium, and imidazopyrazinium quaternary salts. The merocyanine spectral sensitizing dyes include, joined by a methine linkage, a basic heterocyclic nucleus of the cyanine dye type and an acidic nucleus, such as can be derived from barbituric acid, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malonitrile, isoquinolin-4-one, and chroman-2,4-dione. Oxonols, hemioxonols, styryls, merostyryls, and streptocyanines are known in the art and are disclosed in, for example, Hamer, *The Cyanine Dyes and Related Compounds,* 1964 and James, *The Theory of the Photographic Process* 4th, 1977, the disclosures of which are incorporated by reference in their entirety. The amount of sensitizing dye can be any amount known in the art to be useful for spectral sensitization of silver halide. Optimum dye concentration levels can be chosen by procedures taught by Mees, *The Theory of the Photographic Process,* 1942.

The sharpness improvement provided by the present invention is most strongly observed in red-sensitive and green-sensitive silver halide emulsions. Thus, sensitizing dyes that sensitize silver halide in the red or green portions of the spectrum are preferred.

One or more spectral sensitizing dyes may be used to achieve a desired spectral sensitization of the silver halide as well as to achieve results such as supersensitization, as discussed by Gilman in *Photographic Science and Engineering,* Vol. 18, 1974, pp. 418–30. Examples of supersensitizing dye combinations include those disclosed in McFall et al U.S. Pat. No. 2,933,390, Jones et al U.S. Pat. No. 2,937,089, Motter U.S. Pat. No. 3,506,443, and Schwan et al U.S. Pat. No. 3,672,898, the disclosures of which are incorporated herein by reference.

The color-forming coupler can be any of a number of well-known color-forming couplers, as described in *Research Disclosure I.* The coupler preferably forms a non-diffusible dye that is generally complementary to the color for which the silver halide is sensitized. For example, if the silver halide is sensitized to red, the coupler would form a cyan dye, a magenta dye for green-sensitive silver halide, and a yellow dye for blue-sensitive silver halide. Useful color couplers are disclosed in Salminen et al U.S. Pat. Nos. 2,423,730, 2,772,162, 2,895,826, 2,710,803, 2,407,207, 3,737,316, and 2,367,531, Weissberger et al U.S. Pat. Nos. 2,474,293, 2,407,210, 3,062,653, 3,265,506, and 3,384,657, Bailey et al U.S. Pat. No. 3,725,067, Lau U.S. Pat. No. 3,779,763, Lestina U.S. Pat. No. 3,519,429, and Whitmore et al U.S. Pat. No. 3,227,550, the disclosures of which are incorporated by reference. Numerous additional color dye-forming coupler patents are disclosed in *Research Disclosure I.*

The non-diffusible filter dye may be any of a number of known non-diffusible filter dyes or antihalation dyes. By non-diffusible, it is meant that little or none of the dye will migrate out of the layer in which it is coated before the element is exposed. The filter dye may be retained in its entirety in the photographic element after processing or may be such that less of the dye is retained after processing. Also, the color of the dye may change during processing. During photographic development (generally in high pH, e.g., 9 or above, sulfite-containing processing solutions), bleaching, or fixing, the dye is preferably decolorized and/or removed from the element. Decolorization and/or removal is preferable since the resulting image is easier to print or view directly.

The non-diffusible filter dye absorbs light in the region of the spectrum to which the silver halide layer of the element of the invention is sensitized. While the dye will generally absorb light primarily only in that region, dyes that absorb light in other regions of the spectrum as well as the region to which the silver halide is sensitized are also included within the scope of the invention. A simple test as to whether the non-diffusible filter dye is within the scope of the invention is if the speed of the silver halide layer of the element of the invention is less when the filter dye is present than when it is not present, the filter dye is within the scope of the invention.

The filter dye may be a diffusible acidic dye that is rendered non-diffusible by incorporating a base group-containing polymeric mordant for the dye in the dye-containing layer. Such dyes preferably have a sulfo or carboxy group. Red- or green-absorbing dyes are preferred, corresponding to the above-described preferred red- or green-sensitive silver halide emulsions. Useful dyes are generally acidic dyes of the azo type, the triphenylmethane type, the anthraquinone type, the styryl type, the arylidene type, the merocyanine type, the oxonol type, and others known in the art. Polymer mordants are well-known in the art and are described, for example, in U.S. Pat. Nos. 2,548,564, 2,675,316, 2,882,156, and 3,706,563, the disclosures of which are incorporated herein by reference.

The filter dye may also be a solid particle dispersion or a loaded polymer latex of a dye that is insoluble at coating pH's, but soluble at processing pH's, as described in U.S. patent application Ser. No. 07/073,257 and in the U.S. Patent Application entitled "Solid Particle Dispersion Filter Dyes for Photographic Compositions", filed Dec. 23, 1987 in the names of R. E. Factor and D. R. Diehl.

Additionally, the filter dye may be a colored image dye-forming coupler as disclosed in *Research Disclosure I.* The color of such a filter dye may be changed during processing. The filter dye may be a pre-formed image coupler dye, which would generally remain in the film after processing. The filter dye may also be a spectral sensitizing dye immobilized by adsorption to chemically unsensitized silver halide. Such a dye would generally be removed from the element during fixing.

Examples of useful dyes include those shown below:

D-1

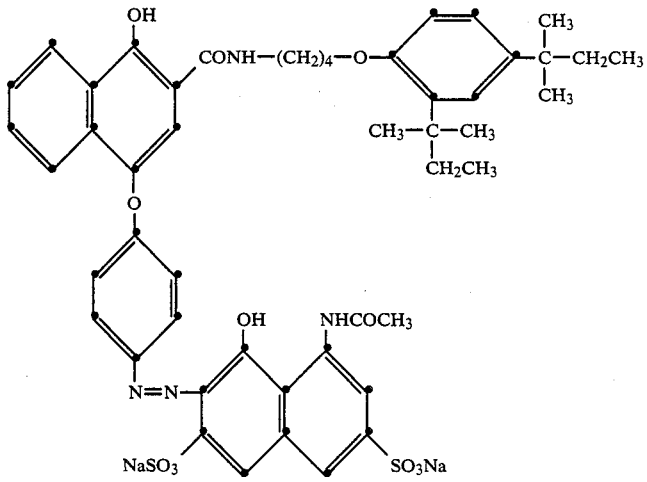

D-2

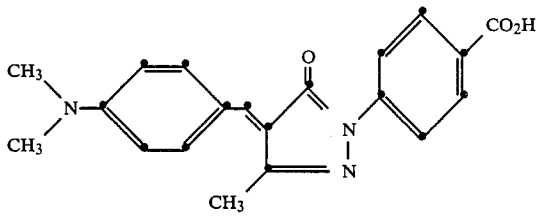

D-3

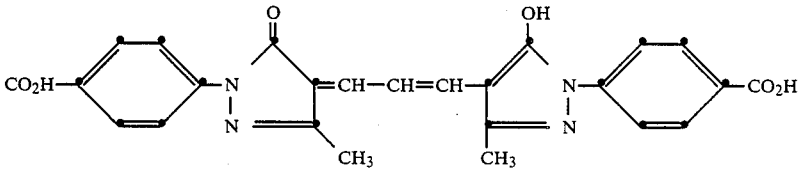

-continued

D-4

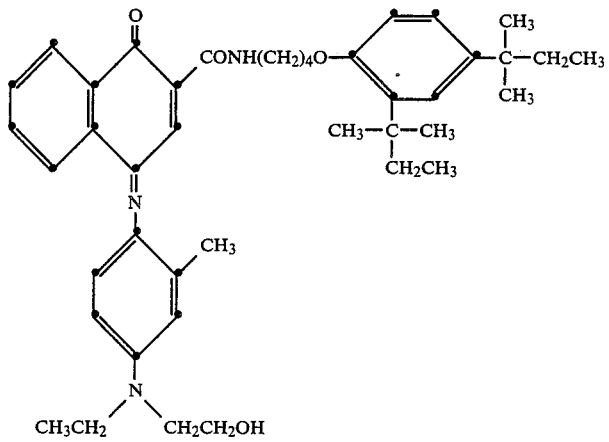

Examples of polymer mordants useful in combination with diffusible acidic dyes in elements of the present invention include the following:

M-1

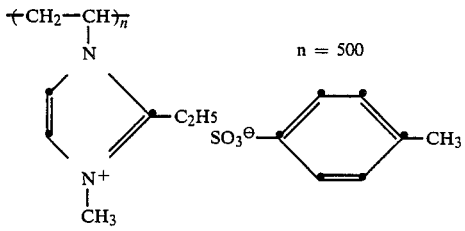

M-2

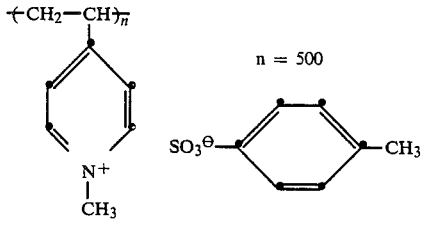

M-3

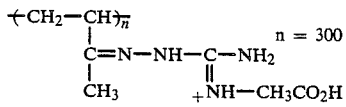

M-4

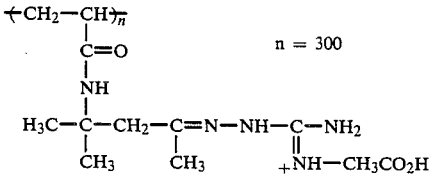

The layers of the element of the invention generally include a vehicle so they can be coated as layers. Useful vehicles include both naturally occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), polysaccharides (e.g., de tran, gum arabic, casein, pectin, and the like), and others, as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.*

The photographic element of the invention will generally contain three silver halide layers or sets of layers: a blue-sensitive layer or set of layers having a yellow color coupler associated therewith, a green-sensitive layer or set of layers having a magenta color coupler associated therewith, and a red-sensitive layer or set of layers having a cyan color coupler associated therewith.

The silver halide-containing layers of the element of the invention can also include any of the addenda known to be useful in light-sensitive photographic layers. These include chemical sensitizers, such as active gelatin, sulfur, selenium, tellurium, gold, platinum, palladium, iridium, osmium, rhenium, phosphorous, or combinations thereof, as described in *Research Disclosure I.*

The element of the invention can include, in any of the silver halide layers, in the non-diffusible filter dye layer, or in any of the other various layers known to be used in photographic elements, various addenda as are known in the art and described in *Research Disclosure I.* these include brighteners, antifoggants, stabilizers, various diffusible and other non-diffusible filter dyes, light absorbing or reflecting pigments, vehicle hardeners such as gelatin hardeners, coating aids, various other dye-forming couplers, and development modifiers such as various other development inhibitor releasing couplers and bleach accelerators, oxidized developer scavengers, antistatic agents, subbing layers, interlayers, overcoat layers, and the like.

The support of the photographic element can be any of the known support materials, as described in *Research Disclosure I.* Examples of supports include cellulose acetate and poly(ethyleneterephthalate).

The layers of the photographic element of the invention can be coated onto the support using techniques well-known in the art. These techniques include immersion or dip coating, roller coating, reverse roll coating, air knife coating, doctor blade coating, stretch-flow coating, and curtain coating. The coated layers may be chill-set or dried, or both. Drying may be accelerated by known techniques such as conduction, convection, radiation heating, or a combination thereof.

The invention is further described in the following Examples. DIR's used in the Examples are identified as follows:

These DIR's and how they are made are well-known in the art. For example, DIR-1 is disclosed in U.S. Pat. No. 4,248,962 and DIR-3 is disclosed in U.S. Pat. No. 4,477,563.

Couplers and other compounds used in the Examples are identified as follows:

DIR-1

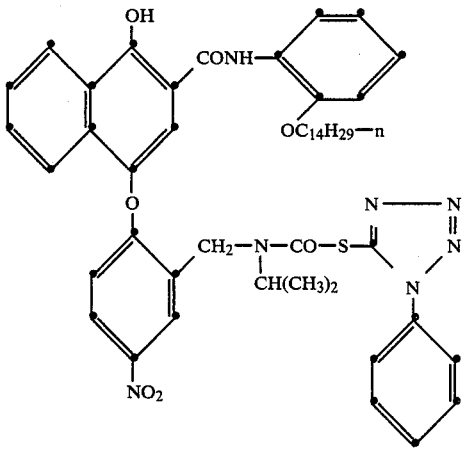

DIR-2

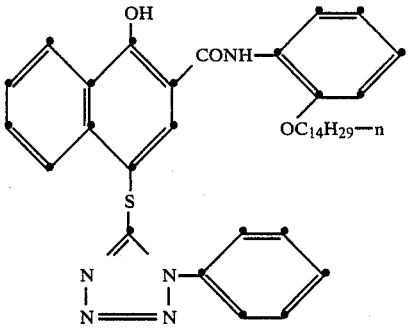

DIR-3

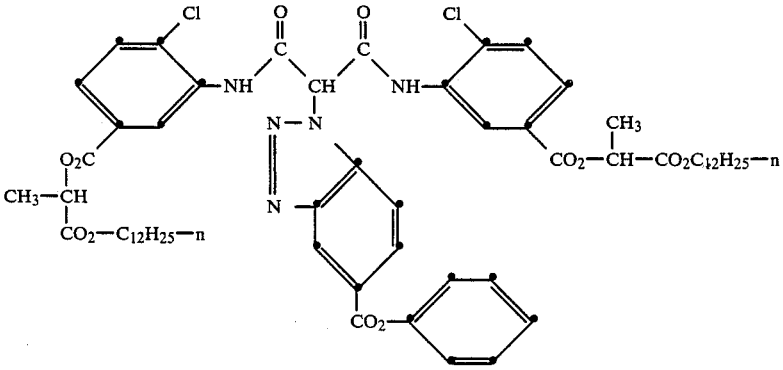

DIR-4

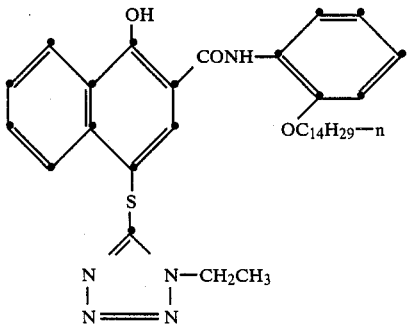

C-1
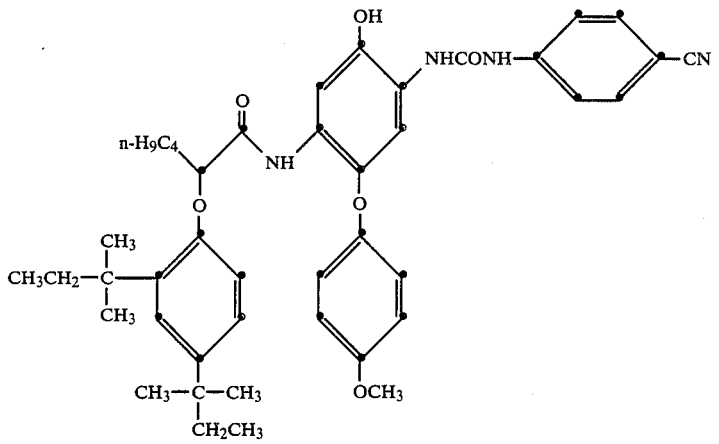
C-2
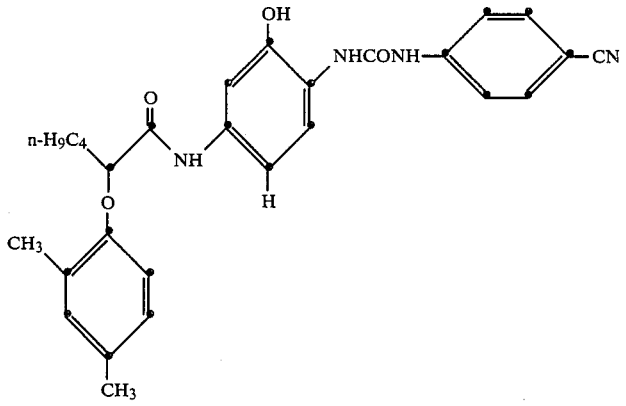
C-3
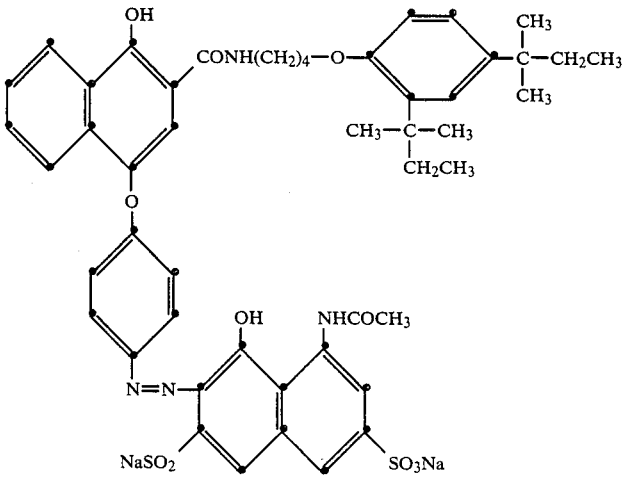

-continued

C-4

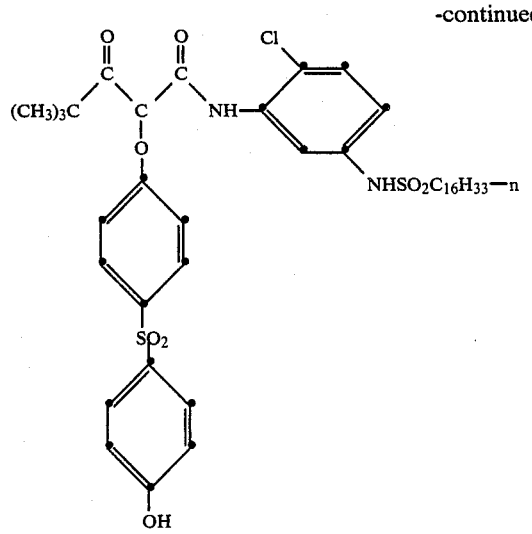

These compounds and methods for making them are also well-known in the art. For example, C-1 and C-2 are disclosed in U.S. Pat. No. 4,333,999, C-3 is disclosed in U.S. Pat. No. 3,476,563, and C-4 is disclosed in U.S. Pat. No. 3,933,501.

EXAMPLES 1–15

Color photographic elements were prepared according to the following format with coating coverages in parentheses (mg/ft$^2$ unless specified otherwise):

| | |
|---|---|
| Overcoat: | Gelatin (260), bis(vinylsulfonylmethyl) ether hardener (1.75% by weight based on dry gelatin), filter dye as specified in Table I (2.0), surfactants and coating aids |
| Interlayer: | gelatin (260), surfactants and coating aids |
| Interlayer: | gelatin (260), surfactants and coating aids |
| Photographic Layer: | green-sensitive $AgI_{6.4\%}Br_{93.6\%}$ with 0.52μ average equivalent circular diameter (150) (sensitized with sensitizing dyes as disclosed below, gelatin (300), 4-hydroxy-6-methyl-1,3,3a,7-tetraazaindene sodium salt (2.4), 2-(2-octadecyl)-5-sulfohydroquinone sodium salt (3), coupler C-1 (68.2) dispersed in half its weight di-n-butylphthalate, DIR as indicated in Table I dispersed in twice its weight diethyl lauramide |
| Film Support | cellulose acetate with antihalation backing layer of gelatin (456) and carbon black |

The coverages for the DIR's were: DIR-1 (11), DIR-2 (12), and DIR-3 (13). Dyes SOL and D-1 were coated as soluble salts (SOL is a diffusible water-soluble dye and D-1 is a ballasted non-diffusible dye) and dyes D-2 and D-3 were coated as solid particle dispersions. The silver halide was sensitized with a mixture of anhydro-5-chloro-9-ethyl-5'-phenyl-3'-(3-sulfobutyl)-3-(3-sulfopropyl)oxacarbocyanine hydroxide, sodium salt and anhydro-5,5'6,6'-tetrachloro-1,1'3-triethyl-3'-(3-sulfobutyl)-benzimidazolocarbocyanine hydroxide. The chemical structure of SOL is:

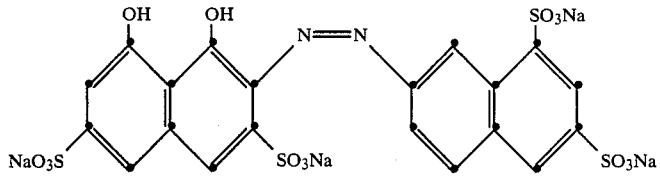

The elements were evaluated for use in a 35 mm format (low magnification emphasizing low spatial frequencies) and in a Disc® format (high magnification emphasizing high spatial frequencies). Image sharpness was evaluated by measuring MTF percent response as a function of spatial frequency and calculating AMT acutance values. Larger values of AMT acutance indicate greater sharpness. This technique is described by R. G. Gendron, "An Improved Objective Method for Rating Picture Sharpness: CMT Acutance," *Journal of the SMPTE,* 82, 1009–12 (1973). Exposures were made through a Wratten 99 green filter with a 35% input modulation.

The elements were processed at 37.8° C. as follows:

| | |
|---|---|
| color developer: | 3.25 min |
| bleach (Fe—EDTA): | 4 min |
| wash | 3 min |
| fix | 4 min |
| wash | 3 min |
| color developer composition: | |
| 4-amino-3-methyl-N—ethyl-beta-hydroxyethylanaline sulfate | 3.35 g/l |
| $K_2SO_3$ | 2.0 g/l |
| $K_2CO_3$ | 30.0 g/l |
| KBr | 1.25 g/l |
| KI | 0.0006 g/l |
| adjusted to pH = 10.0 | |

The AMT acutance values for the exposed and processed elements are presented in Table I. The values for the Disc ® evaluation are shown in parentheses and the values for the 35 mm evaluation are not. Comparative examples outside the scope of the invention are denoted by the letter 'C' followed by the comparative example number.

TABLE I

| Ex. | DIR | Dye | or dye AMT | | Increase in AMT from DIR individual alone | | AMT expected from sum of increases | | Unexpected increase in AMT | |
|---|---|---|---|---|---|---|---|---|---|---|
| C1 | — | — | 90.9 | (84.8) | — | — | — | — | — | — |
| C3 | — | SOL | 91.8 | (85.3) | 0.9 | (0.5) | — | — | — | — |
| C5 | — | D-1 | 92.3 | (86.0) | 1.4 | (1.2) | — | — | — | — |
| C7 | — | D-2 | 91.2 | (83.8) | 0.3 | (−1.0) | — | — | — | — |
| C9 | — | D-3 | 92.7 | (84.9) | 1.8 | (0.1) | — | — | — | — |
| C11 | 1 | — | 99.1 | (97.8) | 8.2 | (13.0) | — | — | — | — |
| C13 | 1 | SOL | 101.7 | (100.6) | — | — | 100.0 | (98.3) | 1.7 | (2.3) |
| 1 | 1 | D-1 | 103.8 | (102.6) | — | — | 100.5 | (99.0) | 3.3 | (3.6) |
| 3 | 1 | D-2 | 103.9 | (101.3) | — | — | 99.4 | (96.8) | 4.5 | (5.1) |
| 5 | 1 | D-3 | 104.6 | (98.5) | — | — | 100.9 | (97.9) | 3.5 | (0.6) |
| C15 | 2 | — | 97.8 | (95.5) | 6.9 | (10.7) | — | — | — | — |
| C17 | 2 | SOL | 99.0 | (96.9) | — | — | 98.7 | (96.0) | 0.3 | (0.9) |
| 7 | 2 | D-1 | 102.1 | (97.6) | — | — | 99.2 | (96.7) | 2.9 | (0.9) |
| 9 | 2 | D-2 | 100.0 | (96.1) | — | — | 98.1 | (94.5) | 1.9 | (1.6) |
| 11 | 2 | D-3 | 104.0 | (98.2) | — | — | 99.6 | (95.6) | 4.4 | (2.6) |
| C19 | 3 | — | 94.2 | (89.3) | 3.3 | (4.5) | — | — | — | — |
| C21 | 3 | SOL | 96.1 | (91.7) | — | — | 95.1 | (89.8) | 1.0 | (1.9) |
| 13 | 3 | D-1 | 96.9 | (92.2) | — | — | 95.6 | (90.5) | 1.3 | (1.7) |
| 15 | 3 | D-3 | 101.3 | (95.4) | — | — | 96.0 | (89.4) | 5.3 | (6.0) |

As is seen in Table I, the combination of DIR's and non-diffusible filter dyes in photographic elements produces an unexpectedly greater increase in image sharpness than would be expected from the increases in sharpness obtainable from the DIR's and filter dyes individually. Also, the non-diffusible filter dyes tend to yield greater increases in image sharpness than the diffusible filter dye.

EXAMPLES 17–22

Sample photographic element similar to those employed in photographic Example 1 were prepared. These samples are schematically outlined below:

| | |
|---|---|
| Overcoat: | gelatin (265), bis(vinylsulfonylmethyl) ether hardener (1.75% by weight to total incorporated gelatin), with or without dye D-4 (9.6) as indicated in Table II, surfactants and coating aids |
| Interlayer: | gelatin (265), suractants and coating aids |
| Interlayer: | gelatin (265), surfactants and coating aids |
| Photographic | fast red-sensitive AgIBr (100), image dye forming coupler C-2 (7.0), magenta colored cyan dye forming color correcting coupler C-3 (2.5), with or without mixture of DIR compound DIR-2 (2.1) and DIR-4 (2.5) as indicated in Table II |
| Photographic | mixture of mid-speed red-sensitive |
| Layer 2: | AgIBr (120) and slow red-sensitive AgIBr (40), image dye forming coupler C-2 (58.0), magenta colored cyan dye-forming color correcting coupler C-3 (1.5), and with or without DIR compound DIR-1 (4.5) as indicated in Table II |
| Film support | with antihalation carbon black, gelatin (45.4) |

The image dye forming couplers and DIR compounds were dispersed as in Example 1. The magenta cyan dye-forming color correcting coupler was employed as its soluble salt. Dye D-4 was dispersed in the same manner as the image dye-forming couplers.

Sharpness was evaluated as described in Example 1 except that a Wratten 29 (red) filter was employed, a 60% input modulation was used, acutance was measured in both the upper and lower sensitometric scale, and acutance was also evaluated for use in Super 8 format film (very high magnification, emphasizing very high spatial frequencies in the film plane).

The materials were processed as in Example 1. Acutance results are presented in Table II.

TABLE II

| # | DIR | Dye | 35 mm AMT (Disc ® AMT [Super8 CMT] | change in AMT due to DIR or dye alone | | | Expected AMT value. | | |
|---|---|---|---|---|---|---|---|---|---|
| | | | (Upper sensitometric scale) | | | | | | |
| C23 | n | n | 89.6(83.8)[83.0] | — | — | — | — | — | — |
| C26 | n | y | 90.4(85.1)[83.6] | +0.8 | (+1.2) | [+0.6] | — | — | — |
| C29 | y | n | 94.4(93.2)[94.9] | +4.5 | (+9.4) | [+11.9] | — | — | — |
| 17 | y | y | 95.1(95.2)[95.9] | — | — | — | 94.9 | (94.4) | [95.5] |
| | | | [Lower sensitometric scale] | | | | | | |
| C32 | n | n | 90.8(85.3)[84.6] | — | — | — | — | — | — |
| C35 | n | y | 91.9(87.4)[85.8] | +1.1 | (+1.9) | [+1.2] | — | — | — |
| C38 | y | n | 93.9(92.3)[93.9] | +3.1 | (+7.0) | [+9.3] | — | — | — |
| 20 | y | y | 96.2(95.4)[95.5] | — | — | — | 95.0 | (93.2) | [95.1] |

At the upper sensitometric scale, the unexpected advantage of Examples 17–19 compared to the expected sharpness improvement from the individual dye and DIR was: +0.2(+0.8)[+0.4]. The unexpected advantage of Examples 20–22 compared to the expected sharpness improvement from the individual dye and DIR was:: +1.2(+2.4)[+0.4].

EXAMPLES 23–40

Color photographic materials were prepared according to the following schematic layer structure (numerical values denote coating coverages in mg/ft$^2$).

| | |
|---|---|
| Overcoat: | Gelatin (260), bis(vinylsulfonylmethyl) ether (1.75% by weight to total incorporated gelatin), with or without dyes SOL, D-1, or D-3 (2.0) according to Table III, surfactants and coating aids |
| Photographic Layer 1: | blue-sensitive AgIBr (72); blue-sensitive AgIBr (38), gelatin (300), yellow image dye forming coupler C-4 (120), dox scavengers and silver stabilizers as in Example 1. |
| Interlayer: | Gelatin (300), interlayer scavenger C-5 (1.0). |
| Photographic Layer 2: | green-sensitive AgIBr (150), gelatin (300), cyan dye forming image coupler C-1 (68.9), dox scavengers and silver stabilizers as in photographic layer 1, and dye SOL (2), DIR-1 (11), DIR-2 (12), or DIR-3 (25) according to Table III |

On rem-jet support.

Image dye-forming couplers, DIR compounds and dyes were dispersed or dissolved as in the previous examples. The emulsions chosen were such as to give equivalent useful speed in both photographic layers after a daylight exposure.

Sharpness of these samples was evaluated as described in the previous examples. A daylight exposure was used to expose the films while a red filter (WR 29) was used to individually monitor the acutance of the green sensitive layer.

Interimage effect (the degree of color correction) was evaluated after a daylight exposure. Interimage, in this case, was quantified as the ratio of the gamma of the green-sensitive layer to that of the blue-sensitive layer. The magnitude of this ratio thus described the degree of interlayer interaction (in a green-sensitive layer onto blue-sensitive layer sense). In situations where it is desirable to minimize the development interactions between the layers in this film, the lowest ratio of the gammas would be indicative of the most desired degree of color interaction.

The films were processed as described in the earlier examples. Sharpness and interimage results are presented below in Table III.

TABLE III

| No. | DIR in 2 | DYE in OC | gamma ratio | Dmin | Change in AMT due to DIR only or DYE only | Unexpected Advantage of combining DIR and Dye |
|---|---|---|---|---|---|---|
| C34 | none | none | — | .08 | — | — |
| C42 | 1 | " | 0.36 | .08 | +1.9(+7.4)[+8.9] | — |
| C45 | 2 | " | 0.23 | .08 | +1.5(+5.6)[+7.1] | — |
| C44 | 3 | " | 0.64 | .09 | +1.9(+5.1)[+5.6] | — |
| C51 | none | (SOL | — | .09 | +0.1(+2.1)[+2.1] | — |
| C54 | 1 | in layer | 0.28 | .08 | — | +0.8(+1.0)[+1.8] |
| C57 | 2 | 2) | 0.23 | .08 | — | +0.7(0)[+0.4] |
| C60 | 3 | " | 0.62 | .10 | — | +0.5(−0.4)[+0.5] |
| C63 | none | (SOL | — | .09 | +0.7(+2.2)[+2.0] | — |
| C66 | 1 | " | 0.30 | .08 | — | +0.2(+0.1)[+0.4] |
| C69 | 2 | " | 0.21 | .08 | — | +0.2(+0.1)[+0.5] |
| C72 | 3 | " | 0.59 | .09 | — | 0(−0.4)[+0.3] |
| C75 | none | D-1 | — | .14 | −0.1(+0.7)[+0.8] | — |
| 23 | 1 | D-1 | 0.31 | .13 | — | +1.2(+1.4)[+1.2] |
| 26 | 2 | D-1 | 0.23 | .13 | — | +0.5(+0.7)[+0.7] |
| 29 | 3 | D-1 | 0.65 | .15 | — | +1.2(+1.1)[+0.4] |
| C78 | none | D-3 | — | .08 | −0.8(+0.2)[+0.6] | — |
| 32 | 1 | D-3 | 0.31 | .08 | — | +2.7(+3.2)[+2.2] |
| 35 | 2 | D-3 | 0.21 | .08 | — | +1.7(+1.5)[+1.7] |
| 38 | 3 | D-3 | 0.61 | .08 | — | +1.7(+1.2)[+0.2] |

Acutance values for the 35 mm, Disc ®, and Super8 evaluations were monitored at mid-scale in the green sensitive layer. The spatial frequencies (degrees of magnification) monitored by these three acutance values were described earlier. The dyes all absorb green light. SOL is a soluble dye used in the prior art. Dye D-1 is a ballasted dye of the invention which remains after processing as a uniform background color. Dye D-3 is a ballasted dye of the invention which does not result in any color after processing. DIR-1 and DIR-3 are generically mobile inhibitor-forming DIR compounds while DIR-2 is generically an immobile inhibitor-forming DIR compound.

Several important features of this invention, in addition to the unexpected advantage demonstrated for the combination of DIR's and non-diffusible filter dyes, are revealed in Table III.

First, the combination of DIR compounds with soluble absorber dyes (C51 through C72) shows a smaller synergistic advantage than is observed with the inventive combinations of DIR compounds with ballasted absorber dyes (C75-C80 and Examples 23 through 40). This holds true whether the soluble absorber dye is coated in the emulsion layer (C51 through C62) or in the overcoat (C63 through C74). This difference appears to occur because the soluble dyes tend to distribute throughout the film so long as any moisture is present. Clearly the ballasted absorber dyes do not have this problem. A similar result was shown earlier in Example 1.

Second, the combinations of ballasted absorber dyes with immobile inhibitor releasing DIR compounds (DIR-2) offer the useful advantage of minimizing the degree of color interaction (Interlayer interimage effect) between the elements of a film. This is a desirable property since it allows large quantities of DIR compound to be added to an element without sacrificing the color reproduction properties of a film.

This invention has been described in detail with particular reference to preferred embodiments thereof. It should be understood, however, that variations and modifications can be made within the spirit and scope of the invention.

What is claimed is:

1. A photographic element for exposure to an image, comprising a support having thereon a layer comprising spectrally-sensitized light-sensitive silver halide and a color dye-forming coupler, a layer, which may be the same as or different than said silver halide layer, comprising a DIR compound that releases a substantially non-diffusible development inhibitor capable of inhibiting development of said silver halide on reacting with an oxidation product of a development agent during development, and a layer, between said silver halide layer and the source of the image exposure, comprising a non-diffusible filter dye that absorbs light in the region of the spectrum to which the silver halide is sensitized.

2. A photographic element according to claim 1 wherein the silver halide is sensitized to red light.

3. A photographic element according to claim 1 wherein the silver halide is sensitized to green light.

4. A photographic element according to claim 1 wherein the non-diffusible filter dye is removable from the element or decolorizable during photographic processing.

5. A photographic element according to claim 1 wherein the non-diffusible filter dye layer is located further from the support than the silver halide layer.

6. A photographic element according to claim 5 wherein the non-diffusible filter dye layer is furthermost from the support of any layer in the element.

* * * * *